US005868374A

United States Patent [19]

Lomando

[11] Patent Number: 5,868,374

[45] Date of Patent: Feb. 9, 1999

[54] PUSH BROOM STAND

[76] Inventor: Steve Lomando, 517 N. Damien, LaVern, Calif. 91750

[21] Appl. No.: 732,104

[22] Filed: Oct. 11, 1996

Related U.S. Application Data

[60] Provisional application No. 60/002,604 Oct. 13, 1995.

[51] Int. Cl.[6] ..... F16M 9/00

[52] U.S. Cl. ..... 248/688; 15/246

[58] Field of Search ..... 248/688, 121, 248/146, 127, 351; 15/257 R, 111, 143, 159 R, 246

[56] References Cited

U.S. PATENT DOCUMENTS

| | | | |
|---|---|---|---|
| 270,624 | 1/1883 | Barnett | 248/688 |
| 490,472 | 1/1893 | Clements | 15/111 |
| 539,357 | 5/1895 | Davis | 248/688 |
| 892,525 | 7/1908 | Jorgensen | 248/688 |
| 1,008,104 | 11/1911 | Ball | 248/688 |
| 1,182,139 | 5/1916 | Brown | 248/688 |
| 1,752,400 | 4/1930 | Sund . | |
| 4,358,123 | 11/1982 | Richards | 15/246 X |
| 5,161,772 | 11/1992 | DiResta et al. | 248/688 |

*Primary Examiner*—Ramon O. Ramirez
*Assistant Examiner*—Long Dinh Phan
*Attorney, Agent, or Firm*—Knobbe, Martens, Olson & Bear, LLP

[57] ABSTRACT

A push broom stand includes an elongated tubular body having a bent shape. The body includes a receiving section configured to removably receive the handle of a push broom, an extending section oriented at an angle to the receiving section, and a support section oriented at an angle to the extending section. The device is hollow so as to define a sleeve configured to snugly fit around the handle of a broom. A slot extends through at least a portion of the body so that a broom handle may be snapped through the slot into the sleeve. The push broom stand is installed onto the lower end of the broom handle of a push broom to thereby support the push broom in an upright position when the broom is not in use. The push broom stand is also configured to be able to hang the broom from an elevated surface.

23 Claims, 4 Drawing Sheets

PUSH BROOM STAND

RELATED APPLICATION

This application is a continuation in part of provisional application Ser. No. 60/002,604 filed Oct. 13, 1995.

BACKGROUND OF THE INVENTION

1. Field of the Invention

The present invention relates to a broom stand, and in particular, relates to a stand that may be used to support a push broom in an upright orientation or to hang a push broom from an elevated surface.

2. Description of Related Art

A typical push broom consists of an elongated, cylindrical handle having a head to which bristles are attached. A person uses a push broom by orienting the bristles against the ground and pushing the broom with the handle so that the bristles scrape against the ground, thereby sweeping debris from the ground.

It is common for a push broom to be supported in an upright position when the broom is not being used. But unless a user has ready access to a wall to lean the broom against, there is no easy and convenient means of supporting a push broom in an upright position when the broom is not being used. Hence, a user often resorts to lying the push broom flat on the ground when the user is not using the broom. This is often the case when the user is taking a brief break from sweeping and the nearest wall to support the broom upright is considered too far away. But there are certain drawbacks associated with laying a push broom flat on the ground.

For example, an unsuspecting person may easily trip over a broom that is left laying on the ground. Moreover, a push broom that is left unattended on the ground presents the risk that a person will accidentally step on the head of the broom. This may cause the broom handle to swing upward at a high rate of speed and possibly strike the person in the body or face, which may potentially cause serious injury to the person.

Further, a person must stoop down to pick up a broom lying on the ground. Repeated stooping up and down to pick up a broom from the floor is tiresome, and may cause injury to a person's back. Existing back injuries may also be exacerbated if the individual is required to repeatedly bend over to pick up a broom. Further, some injuries may prevent a person from picking a broom off the floor, or may make it very difficult to do so.

Even if a person has access to a wall to lean the broom against, it may not always be desirable to lean a broom against a wall. If the broom is left with the bristles of the broom lying against the ground at an angle so as to bend the bristles, the bristles may eventually warp in shape from supporting the weight of the broom, especially during longer periods of storage. Furthermore, leaning a broom against a wall may be impractical, as the broom may use up space that is needed for storage of other items. In such instances, it may be desirable to hang the broom to conserve space. Unfortunately, there is no easy means of hanging a push broom absent installing a hook on a wall which is often troublesome or inconveniently located.

In view of the foregoing drawbacks, there is a need for a device and method a push broom in an upright position without leaning the broom against a wall. There is also a need for a way to support a broom in a hanging orientation without requiring the installation of a hook on a wall.

SUMMARY OF THE INVENTION

The aforementioned needs are satisfied by the present invention. In one aspect of the invention, a push broom stand comprises an elongated body that is configured to support a push broom in an upright position. The body includes a receiving section defining a sleeve that is configured to removably receive a handle of a push broom, an extender section extending outward from the receiving section and oriented at a first angle with respect to the receiving section, and a support section extending outward from the extender section and oriented at a second angle with respect to the extender section. The push broom handle may be inserted into the receiving section of the elongated body so that the support section supports the push broom in an upright position. The support section of the elongated body is also configured to rest over an elevated surface so as to hang the push broom from the elevated surface when the push broom is positioned within the sleeve of the receiving section.

In another aspect of the invention, a push broom stand comprises an elongated body configured to removably receive a handle of a push broom within a sleeve defined by the elongated body. When the push broom handle is inserted into the sleeve, the elongated body is in an angular relationship with the push broom such that the push broom may be balanced against the push broom stand so that the elongated body supports the push broom in an inclined, upright orientation.

There is thus advantageously provided a broom stand having an elongated member with a first receiving section configured to releasably attach to a broom handle, and a second section orientated at an angle to the first section to support a broom inserted into the first section at an angle relative to ground. The elongated body advantageously comprises a hollow tube with a slot through at least the first section wherein the slot and tube are sized to resiliently pass the handle of a broom into the hollow body and hold the stand onto the handle. The tube is bent at a first angle away from the handle toward the ground, and the tube has a length sufficient to have a distal end of the tube contact the ground to support the broom at an angle of between about 30 to 75 degrees relative to the ground.

There is also provided receiving means for receiving and griping a broom handle, and support means connected at an angle to the receiving means to support a broom handle inserted into the receiving means at an angle relative to ground. These means include a tube having a length and at least one bend selected to support a broom inserted in to the slot at an angle relative to the ground.

There is also advantageously provided a method of supporting a broom. This method includes the steps of inserting an elongated broom handle into a tube through a slot in the tube, bending the tube at a first angle away from the handle toward the ground, forming the tube with a length sufficient to have a distal end of the tube contact the ground to support the broom at an angle of between about 30 to 75 degrees relative to the ground. This method can further include the step of bending the tube at a second angle intermediate the handle and the distal end of the tube, and selecting the second angle to allow the broom to be suspended from even a horizontal surface by the portion between second bend and the distal end. Finally, the method can include the further step of locking the broom handle into the tube by passing an annular member over the slot and around a substantial portion of the tube. Preferably, the first and second angles and the length of the tube are selected so that bristles on the broom are substantially perpendicular to the ground when the distal portion of the tube rests on the ground.

Broadly defined, there is advantageously provided a slotted ring for engaging a broom handle, with one end of a stand attached to the ring and the other end of the stand resting on the ground to support the broom when the broom is not in use. The split ring can grip the handle with predetermined tightness in order to allow the ring to rotate relative to the handle, to rotate and slide relative to the handle, or to be permanently affixed to the handle.

These and other features of the invention will now be described with reference to the drawings of preferred embodiments of the push broom stand. The illustrated embodiments of the push broom stand are intended to illustrate, but not to limit the invention.

DETAILED DESCRIPTION OF THE PREFERRED EMBODIMENT

Figure 1:
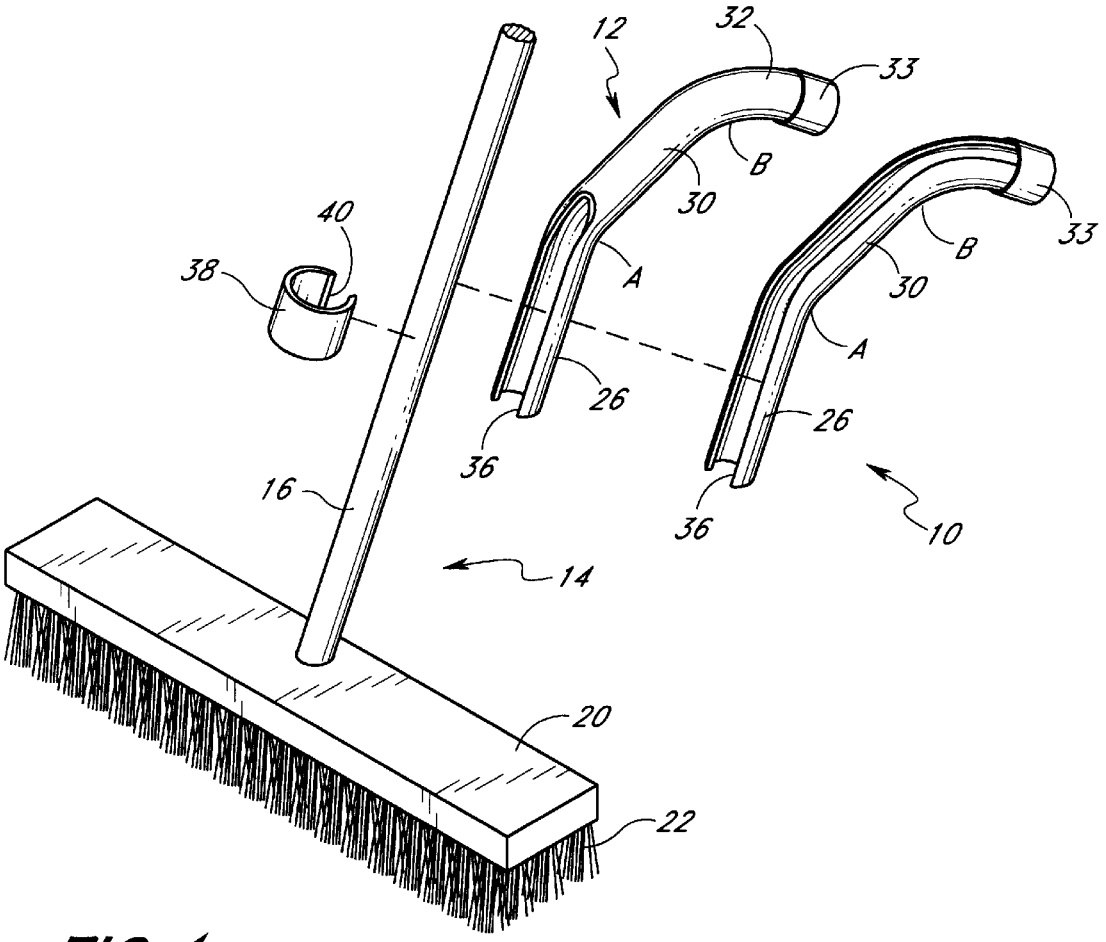
FIG. 1 is a perspective view of a preferred embodiment of the push broom stand of the present invention.

Referring to FIG. 1, a preferred embodiment of the invention includes a push broom stand 10 with an elongated body 12 having a tubular shape and two bends A, B along its length. The stand 10 is configured to be used in conjunction with a conventional push broom 14 having an elongated, cylindrical handle 16. A broom head 20 with brushes or bristles 22 is attached to one end of the broom handle 16.

The body 12 of the push broom stand 10 consists of a connecting or receiving section 26, a middle or extender section 30, and a distal or support section 32. The receiving section 26 is located distal of bend A, and is configured to removably receive a broom handle, as described in detail below. The middle or extender section 30 is located between bends A, B, and extends outward at an angle A from the receiving section 26. The support section 32 is located distal of bend B, and extends outward at an angle B from the extender section 30. A cap 33 fits over the distal end of the support section 32. Although the illustrated embodiment uses a body 12 having a cylindrical shape, it will become apparent from the following description that the body 12 need not be cylindrical to remain within the scope of the invention.

The connecting or receiving section 26 is hollow with an inner diameter corresponding to the diameter of the broom handle 16. Preferably the shape of the receiving section 26 conforms to the shape of the handle 16 so that the broom handle 16 fits snug within the section 26. Typical broom handles have diameters of ¾" to 1" and it is desirable that the diameter of inside of receiving section 26 the match the diameter of the broom handle, or be slightly smaller in order to eliminate the need for additional fasteners to hold the stand 10 onto the broom 14. It will be appreciated that the inside of receiving section 26 could take on a variety of shapes, not necessarily circular, that are configured to snugly receive the broom handle 16.

A slot 36 extends through the length of the receiving section 26 and through a portion of the length of the extender section 30. As also shown in FIG. 1, the slot 36 may extend the entire length of the broom holder 10. This slot 36 gives the receiving section 26 a "C" shaped cross section. The slot 36 is advantageously configured so that the broom handle 16 may be snapped into the sleeve 26 through the slot 36. Therefore, the slot 36 should be wide enough to receive a broom handle but small enough to secure the broom handle 16 within the sleeve 36 once the broom handle 16 is inserted. The receiving section 26 is preferably made of plaster or other material with sufficient resiliency to allow the slot 36 to expand when the handle 16 is inserted, yet grasp the handle 16 once it has passed through slot 36.

Figure 2:
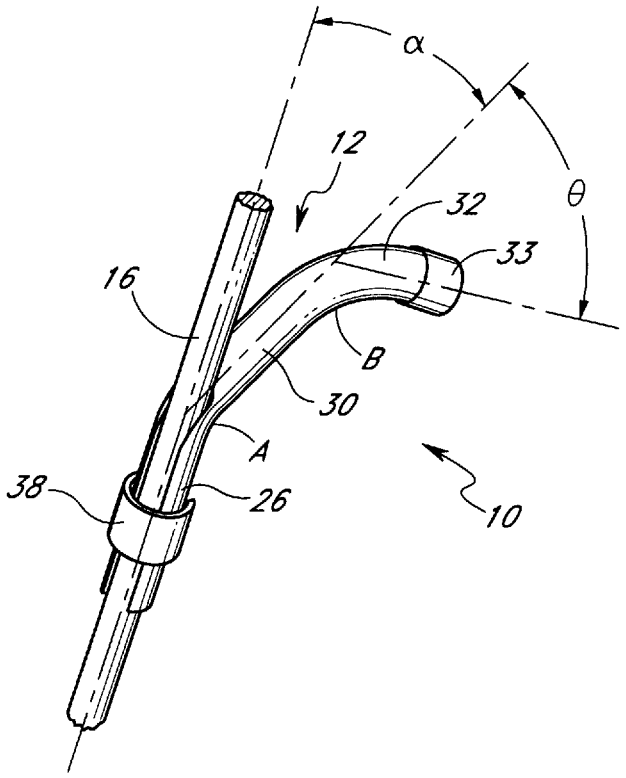
FIG. 2 is a perspective view of a preferred embodiment of the push broom stand of the present invention as it appears when attached to a broom handle.

FIG. 2 illustrates the broom stand 10 having a broom handle 16 installed in the receiving section 26. As discussed, it is desirable that the slot 36 extend at least through a portion of the extender section 30, as the broom handle 16 intersects with the extender section 30 when the handle 16 is installed in the receiving section 26 as shown in FIG. 2.

The snug fit between the broom handle 16 and the sleeve 26 reduces the likelihood that the broom handle 16 will inadvertently slip out of the sleeve 26. If desired, a clamping ring or annular protector 38 may also be used to further ensure the handle 16 gripped with a desired force. This protector 38 is optional, and not required as the difference in size between the handle 16 and receiving section 26 may be selected to provide sufficient gripping force. Protector 38 is configured to fit over the receiver portion 26 of the body 12. The protector 38 is cylindrically shaped and has a slot 40. Preferably, the slot 40 is sized so that the protector 38 may be snapped over the receiver section 26 once the broom handle 16 is installed in the sleeve 26. The protector 38 functions to further secure the broom handle 16 within the sleeve 26 and thereby reduce the risk that the broom handle 16 will inadvertently slip out of the sleeve 26. The protector 38 advantageously secures the body 12 to handle 16, but preferably allows the body 12 to rotate about handle 16.

Alternatively, the protector 38 may be slid over the handle 16 to further resiliently urge the receiving section 26 to grip the handle 16. A conventional radiator clamp could also be used to provide further tightening or adjustment of the force with which the receiving section 26 grips the handle 16. In a still further variation, opposing sides of the slot 36 may be urged together by placing a screw through projections (not shown) on each opposing side of the slot 36, with the screw tightened or loosened to adjust the gripping force.

Figure 3:
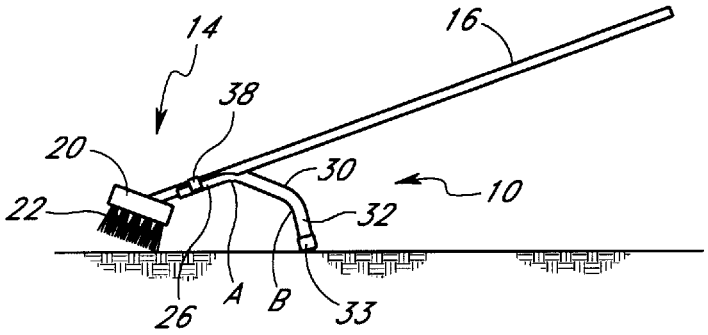
FIG. 3 is a side view of the push broom stand illustrated in FIG. 1 being used to support a push broom in a first upright orientation.

As shown in FIGS. 3 through 6, the push broom stand 10 supports a push broom 14 in a variety of upright positions. Referring to FIG. 3, the push broom 14 may be oriented in a first upright position by inserting the broom handle 16 into the receiving section 26 of the push broom stand 10 so that the extender and support sections 30 and 32 face away from the broom head 20. Preferably, the push broom stand 10 is positioned at the lower portion of the broom handle 16 near the head 20. Preferably, the receiving section 26 grips the handle 16 sufficiently tight to support the broom 14, but loose enough so the stand 10 can be slid along the length of the handle 10 to provide for some adjustment.

In this configuration, the broom stand 10 is interposed between the broom handle 16 and the ground so that when the broom handle 16 is released by a user, the broom stand 10 supports the broom 14 in an upright position. In particular, the extender section 30 of the broom stand 10 extends outward from the broom handle 16 at an angle A, and the support section 32 extends outward at an angle from the extender section 30 at an angle B, such that the cap 33 abuts the ground when the stand 10 is in use. In this position, the broom stand 10 supports the broom in an upright position with the bristles 22 and the cap 33 on the support section 32 acting as contact points on the ground. As shown in FIG. 1, the head 20 of the broom 10 has an elongated shape so that the head 20 preferably provides stability to prevent the broom 14 from toppling over when the broom 14 is in the upright position. There is thus advantageously provided a slotted tube or slotted ring for connection to a broom handle 16. A support member is provided with one end of a support member affixed to the ring and the other end of the support member resting on the ground when the broom 14 is not in use. The configuration of this support member can take a variety of shapes and forms, varying from straight to a generally "C" shaped configuration, as discussed in more detail herein. The shape of this support member can also vary from tubular, to a slotted tube, to a solid member, as discussed in more detail herein.

The angles A, B and the length of the sections 30, 32 are preferably selected so the bristles are perpendicular to the floor, and advantageously so the bristles 22 are not at an angle of more than 10 degrees from perpendicular. The greater the angle the cause greater the permanent bending of the broom's bristles. The stand 10 may be slid along the length of the handle 16 is adjustment is needed.

Figure 4:
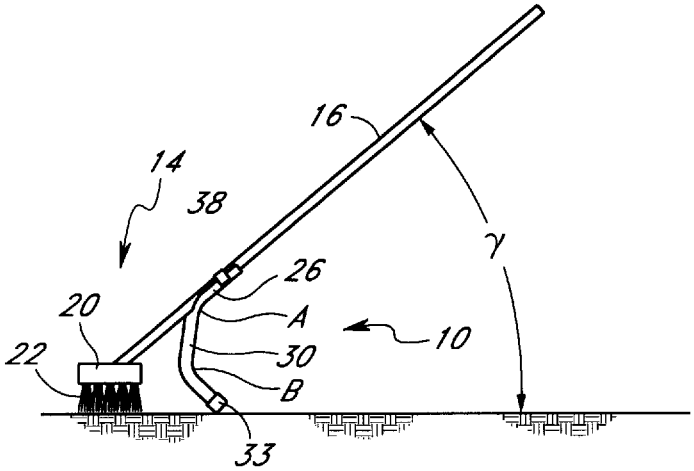
FIG. 4 is a side view of the push broom stand illustrated in FIG. 1 being used to support a push broom in a second upright orientation.

Referring to FIG. 4, the broom stand 10 may also be used to support the broom 14 in a second upright orientation. In the configuration, the broom stand 10 is positioned on the broom handle 16 so that the extender and support sections 30 and 32 point toward the broom head 20. The broom stand 10 supports the broom 14 in a manner similar to that described above with reference to FIG. 3, but the generally curved shape of the stand 10 results in a different angle of inclination relative to the ground, for the broom 14.

In the configurations shown FIGS. 3 and 4, the broom 14 is advantageously oriented so that the broom bristles 22 rest against the ground when the broom 14 is supported upright by the broom stand 10 the stand 10 may be slid along the handle 16 the adjust the angle as needed to bristles 22 are perpendicular to the ground. However, for the configuration shown FIG. 4 the angle $\gamma$ between the broom handle 16 and the ground is less than the angle in the configuration illustrated in FIG. 3, and unless the lengths of the extender section 30 or support section 32 are increased, or unless the angles A, B are changed as needed, it may be difficult to get the bristles 22 perpendicular to the ground.

With the broom stand 10 positioned as shown in FIGS. 3 or 4, a user who wishes to take a break from sweeping need only release the broom 14 so that the broom stand 10 supports the broom 14 upright. When the user returns from the break, he or she only needs to lift the broom handle 16 and begin sweeping, as the bristles 22 are already in a correct orientation with respect to the ground. In some situations it may be more desirable to have the broom handle readily accessible at a desired angle or height, than to avoid bending the bristles 22. Thus, the lengths of the various sections of the stand 10 may be varied, and the angles A, B varied, to achieve any desired position of the handle 16. Preferably, though, the broom handle 16 is held by the stand 10 at an angle gamma $\gamma$ (FIG. 2) relative to the ground, where the angle gamma is between 30 and 75 degrees.

In certain situations, a user may desire to lower the broom handle 16 closer to the ground, such as when sweeping hard to reach areas. In such situations, the user may easily move the broom stand 10 out of the way by rotating the receiving section 26 of the stand around the handle 16 so that the extender and support section 30 and 32 face upward rather than towards the ground. In this position, the broom stand 10 does not interfere with the broom handle 16 being lowered close to the ground. This is advantageous, as the broom stand 10 rarely needs to be removed from the broom handle 16, even when sweeping hard to reach areas.

Figure 5:
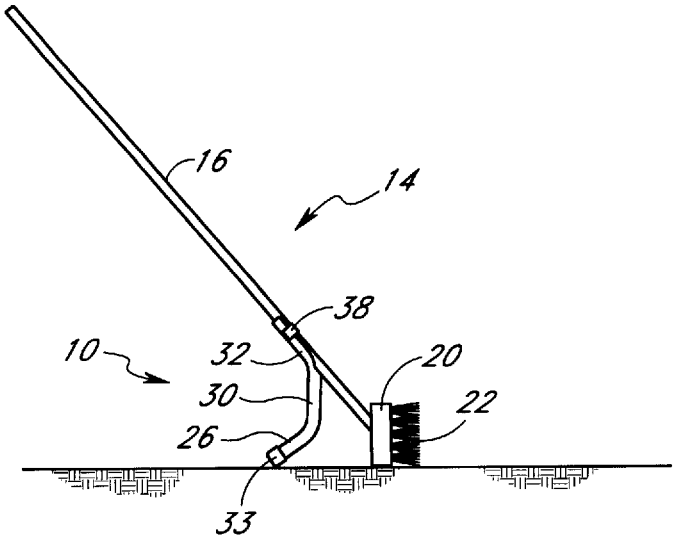
FIG. 5 is a side view of the push broom stand illustrated in FIG. 1 being used to support a push broom in a third upright orientation.

As discussed, the configurations shown in FIGS. 3 and 4 are preferably used for temporary storage of the broom 14, such as during brief intervals in sweeping. When the broom 14 is stored for relatively longer periods of time it is generally desirable to orient the brushes 22 so that the brushes 22 do not support the weight of the broom 14. As best shown in FIG. 5, the broom stand 10 may also be used to stand the broom upright in a position where the brushes 22 will not be warped. In this configuration, the brushes 22 are preferably oriented so that the head portion 20 of the broom 14, rather than the brushes 22, support the weight of the broom 14. In this configuration, the distal end of the stand 10 is rotated about handle 16 to face away from the direction in which the free ends of bristles 22 are pointing. Preferably, the stand 10 is slidably positioned on handle 16 to reduce the bending of bristles 22, or positioned to leave the handle 16 in a desired orientation.

While it is preferable to have the stand 10 able to rotate about the handle 16, and also able to slide along the length of the handle 16, for some applications the user may want the stand 10 permanently positioned on the handle 16. Thus, a screw (not shown) may be passed through the stand 10 into the handle 10 to affix the stand 10 to the handle 16. Alternatively, the protector 40 may be selected to provide sufficient clamping force to hold the stand 10 stationary on the handle 16.

Figure 6:
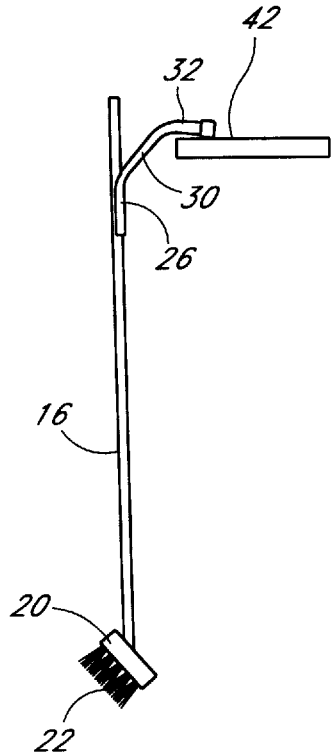
FIG. 6 is a side view of the push broom stand illustrated in FIG. 1 being used to hang a push broom from an elevated surface.

Referring to FIG. 6, the broom stand 10 may also be used to hang the broom 14 from elevated surfaces. To hang the broom 14 using the broom stand 10, the broom stand 10 is preferably positioned adjacent the broom head 20 with the stand 10 orientated so that the bristles 22 are directed away from any adjacent wall. The support portion 32 of the broom stand 10 is then positioned over an elevated surface 42 so that the support section 32 supports the weight of the broom 14 in a hanging position. Hence, a hook or other such hanging apparatus is not necessary to hang a broom using the broom stand 10. The distal support section 32 acts as a hook attached to the broom 14 with the angle B between the extender section 30 and distal support section 32 being sufficient to allow the support section 32 to suspend the broom 14 from even a flat, horizontal surface. The end cap 33 can inhibit sliding off of such flat surfaces. Thus, the angle B is preferably selected to enable the broom 14 to be hung or suspended. From the present disclosure, it will be apparent to one skilled in the art that if desired, the second bend B in the stand 10 can be omitted if the hook and hanging advantages of this invention are not desired.

For the illustrated embodiments of the broom stand 10, there is a distance of about 16 inches from the distal tip of the receiving section 26 to the distal tip of the support section 32, with the center or extender section 30 being about 8 inches long. As discussed, the support section 32 and the receiving section 26 are each oriented at an angle relative to the extender section 30 of the broom stand 10. Referring to FIG. 2, an angle $\theta$ of about 45° between the longitudinal axis of the support section 32 and the longitudinal axis of the extender section 30 is preferred to support the broom 14 in an upright position. This corresponds to an angle of 135° for Angle B. Furthermore, an angle α of about 45° between the longitudinal axis of the receiving section 26 and the longitudinal axis of the extender section 30 is also preferred. This corresponds to an angle of about 135° for angle A. However, it will be appreciated by those skilled in the art that various angles could be used depending upon the desired upright orientation for the broom 14 and the lengths of the various sections of stand 10.

The broom stand 10 may advantageously be made using one inch outer diameter, 0.75 inch inner diameter, standard polyvinylchloride (PVC) pipe. Preferably, the slot 36 is cut through either the entire length of a single piece of pipe or a portion of the pipe as shown in FIG. 1. Heat is then applied to the single piece of pipe to soften the pipe so that the bends can be formed to the desired angles. Alternatively, the pipe may be bent first and then the slot 36 cut into the pipe, but this is not as efficient. Further, three separate PVC pipes may be attached at angles to form the broom stand 10. The broom stand 10 may also be manufactured using an injection mold or by machining a piece of material into the shape of the stand 10. Preferably the stand 10 is made from a single piece of material.

A number of advantages are associated with the broom stand. The stand 10 allows a user to orient the broom 14 in an upright position, which is much safer than lying the broom on the ground. When the broom handle 16 is upright, the broom 14 is more easily viewable so as to reduce the likelihood of a person tripping over the broom or stepping on the broom and causing it to swing upward and strike the person. Furthermore, an upright broom handle 16 eliminates the need for a user to stoop down to pick up the broom, which reduces back problems associated with repeated stooping. The broom stand 10 may also be used to conserve space by hanging a broom 14 from elevated surfaces. The stand 10 works on inclines as well as flat surfaces with the slide 16 positioning of the stand 10 relative to handle 16 to adjust the orientation of the handle 16 relative to the grounds.

If an initially straight, 16 inch long, 0.75 inch inner diameter, PVC pipe is used, then the receiving section 26 advantageously has a length of about 4–5 inches along its central axis. If only a portion of the tube is slotted, then slot 36 preferably has a length of about 5.5–6 inches. The middle section, or extender section 30, advantageously has a length of about 6–7 inches, along its central axis, while the distal end or support section 32 has a length of about the same as the receiving section. The slot 36 is advantageously wide enough to admit the handle 16 without undue force, but narrow enough to retain handle 16 once the handle is inserted. For a one inch diameter PVC pipe with an inner diameter of about 0.8 inches, a slot 36 with a width of about 0.7 inches is suitable. If additional strength is desired, the middle and distal sections 30, 32 may be solid, or may be filled with a strengthening plug of material. A vinyl end cap 33 is preferred.

Although the preferred embodiment of the present invention has disclosed the features of the invention as applied to these embodiments, it will be understood that various omissions, substitutions, and changes in the form of the detail of the embodiments illustrated may be made by those skilled in the art without departing from the spirit of the present invention. Consequently, the scope of the invention should not be limited to the foregoing disclosure.

Thus, for example, a stand could be permanently connected to the broom handle 16 rather than rotatably or slidably connected to the handle 16. Further, the number of bends A, B in the stand could increase, or decrease to one bend, or even no bends. A stand could be attached to rotate about handle 16, but not slide. A stand could also be positioned along the length of handle 16, without sliding.

What is claimed is:

1. A broom stand for supporting a broom having an elongated handle, comprising an elongated body having a receiving section containing an elongated aperture extending along the length of the receiving section and sized and configured to removably receive said handle of a push broom with the receiving section sized to resiliently grip said handle when inserted through the aperture, an extender section extending outward from said receiving section and oriented at a first angle α with respect to said receiving section, a support section extending outward from said extender section and oriented at a second angle θ with respect to said extender section, the support section having an end configured to rest upon the ground when the receiving section engages said broom handle to support the push broom in an upright position, wherein said first and second angles cooperate to form a structure for supporting said broom handle at an angle of less than 75° relative to the ground.

2. The broom stand of claim 1, wherein said first angle is about 45 degrees.

3. The broom stand of claim 1, wherein said second angle is about 45 degrees.

4. The broom stand of claim 1, additionally including an annular protector configured to slidably fit around said receiving section to secure a broom handle within said receiving section.

5. The broom stand of claim 1, wherein said aperture further extends through at least the extender section.

6. The broom stand of claim 1, wherein said receiving section is configured to grip the broom handle while still allowing the handle to rotate and slide when pushed, in order to orientate and position the stand on the broom handle when the broom handle is inserted into the receiving section.

7. The stand of claim 1, wherein the support section is also configured to rest upon an elevated surface when the receiving section engages the handle to support the utility device in an hanging position.

8. A broom stand for supporting a push broom having an elongated handle, comprising an elongated body configured to removably receive said handle of said push broom within an interior space defined by said elongated body, said elongated body including an elongated slot communicating with said interior space wherein said elongated slot is sized to resiliently receive said broom handle therethrough, said elongated body being in an angular relationship with said push broom when said push broom handle is positioned within said sleeve such that said push broom may be balanced against the push broom stand so that said elongated body adapted to support said push broom in an inclined orientation of less than 75° relative to a surface upon which the elongated body rests to support the broom in said inclined orientation, wherein said elongated body includes a first section defining said interior space which is configured to slidably receive said push broom stand, a second section extending outward at an angle A from said first section, and a third section extending outward at an angle B from said second section, said third section configured to rest against the ground and adapted to support said push broom in an upright position when push broom handle is inserted in said interior space.

9. The broom stand of claim 7, wherein said angles are about equal to 135 degrees.

10. A broom stand for supporting a broom having an elongated handle, comprising an elongated member having a first receiving section configured to releasably attach to the elongated handle, and a second section oriented at an angle to the first section and a third section for supporting the broom when inserted into the first section at an angle of between 30° and about 75° relative to the ground, wherein the first receiving section and second section may be substantially positioned within a single plane containing the broom handle.

11. The broom stand of claim 10, wherein the elongated body comprises a hollow tube with a slot through at least the first section wherein the slot and tube are sized to resiliently pass the handle of a broom into the hollow body and hold the stand onto the handle.

12. The broom stand of claim 10, wherein the second section is also oriented at an angle to the first section to support a broom inserted into the first section in a suspended orientation from an elevated surface.

13. A broom stand for supporting a broom having an elongated handle, comprising receiving means for receiving and gripping the elongated handle when the elongated handle is inserted into the receiving means, and support means connected at an angle to the receiving means for supporting the broom when the elongated handle is inserted into the receiving means at an angle relative to ground that is substantially non-vertical, wherein the receiving means and the support means are substantially positioned within a single plane containing the elongated handle when the elongated handle is inserted into the receiving means.

14. A broom stand for supporting a broom having a broom handle, comprising an elongated piece of plastic tube with a slot running the substantial length of the plastic tube, the slot and the inside of the tube sized to be slightly smaller than the size of the broom handle to grip the broom handle when the broom handle is inserted into the tube through the slot, the tube having a length and at least one bend selected for supporting the broom when the broom handle is inserted into the slot at an angle in a non-vertical orientation relative to the ground, wherein the entire length of the plastic tube is substantially positioned within a plane defined by the broom handle and the tube when the broom handle is inserted into the tube.

15. A broom and stand, comprising a broom with an elongated handle inserted into a slotted tube sized to receive the handle of the broom, the tube connected to a support member extending at a first angle away from the handle toward the ground, the support member having a length sufficient to have a distal end of the support member contact the ground for supporting the broom at an angle of between about 30 to 75 degrees relative to the ground, wherein the handle of the broom, the tube and the support member are collectively positioned within a common plane when the elongated handle is inserted into the slotted tube.

16. A broom stand as defined in claim 15 wherein the support member comprises a tube bent at a second angle intermediate the handle and the distal end of the tube, the second angle being sufficiently great to allow the broom to be suspended by the portion between second bend and the distal end.

17. A method of supporting a broom having an elongated broom handle, comprising the steps of inserting the elongated broom handle into a tube through an elongated slot in the tube, locking the broom handle into the tube by passing an annular member over the slot and around a substantial portion of the tube, bending the tube at a first angle away from the handle toward the ground, forming the tube with a length sufficient to have a distal end of the tube contact the ground to support the broom at an angle of between about 30 to 75 degrees relative to the ground.

18. A method as defined in claim 17, comprising the further steps of bending the tube at a second angle intermediate the handle and the distal end of the tube, and selecting the second angle to allow the broom to be suspended from a horizontal surface by the portion between second bend and the distal end.

19. A method as defined in claim 18, comprising the further steps of selecting the first and second angles to be about 45 degrees, each.

20. A method as defined in claim 18, comprising the further steps of selecting the first and second angles and the length of the tube so that bristles on the broom are substantially perpendicular to the ground when the distal portion of the tube rests on the ground.

21. The method of claim 17, additionally comprising forming the tube with a length sufficient to have a distal end of the tube contact an elevated surface to support the broom in a hanging position.

22. A stand for supporting a broom having an elongated handle, comprising an body having a receiving section containing an aperture sized and configured to removably receive said handle with the receiving section sized to resiliently grip said handle when inserted through the aperture, an extender section extending outward from said receiving section and oriented at a first angle $\alpha$ with respect to said receiving section, a support section extending outward from said extender section and oriented at a second angle $\theta$ with respect to said extender section, the support section having an end configured to rest upon the ground when the receiving section engages said broom handle to support the broom in an upright position, and an annular protector configured to slidably fit around said receiving section to secure the handle within said receiving section.

23. A method of supporting a broom having an elongated broom handle, comprising the steps of inserting the elongated broom handle into a tube through a slot in the tube, locking the broom handle into the tube by passing an annular member over the slot and around a substantial portion of the tube, bending the tube at a first angle away from the handle toward the ground, forming the tube with a length sufficient to have a distal end of the tube contact the ground to support the broom at an angle of between about 30 to 75 degrees relative to the ground.

* * * * *